US011346105B2

(12) United States Patent
Shaw et al.

(10) Patent No.: US 11,346,105 B2
(45) **Date of Patent: *May 31, 2022**

(54) CONCRETE DOWEL SLIP TUBE ASSEMBLY

(71) Applicant: Shaw & Sons, Inc., Costa Mesa, CA (US)

(72) Inventors: Ronald D. Shaw, Costa Mesa, CA (US); Javier Garcia, Costa Mesa, CA (US)

(73) Assignee: Shaw & Sons, Inc., Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/989,515

(22) Filed: Aug. 10, 2020

(65) Prior Publication Data

US 2020/0378120 A1 Dec. 3, 2020

Related U.S. Application Data

(63) Continuation of application No. 16/740,134, filed on Jan. 10, 2020, now Pat. No. 10,774,479, which is a (Continued)

(51) Int. Cl.

| | |
|---|---|
| ***E04C 5/06*** | (2006.01) |
| ***E04C 5/20*** | (2006.01) |
| ***E01C 11/14*** | (2006.01) |
| ***E04B 1/48*** | (2006.01) |
| ***E04B 5/32*** | (2006.01) |

(52) U.S. Cl.

CPC ..... *E04C 5/0645* (2013.01); *E01C 11/14* (2013.01); *E04B 1/483* (2013.01); *E04B 5/32* (2013.01); *E04C 5/203* (2013.01); *E04B 2005/324* (2013.01); *E04B 2103/02* (2013.01)

(58) Field of Classification Search

CPC . E01C 11/14; E04B 1/483; E04B 5/32; E04B 2005/324; E04B 2103/02; E04C 5/0645; E04C 5/203

See application file for complete search history.

(56) References Cited

U.S. PATENT DOCUMENTS 2,193,129 A 3/1940 Geyer et al.
2,207,168 A 7/1940 Thomas et al.
(Continued)

OTHER PUBLICATIONS

Patent Cooperation Treaty, International Search Report and Written Opinion for International Application No. PCT/US2018/065803, dated Jan. 28, 2019, 8 pages.

*Primary Examiner* — Andrew J Triggs
(74) *Attorney, Agent, or Firm* — Stetina Brunda Garred and Brucker

(57) ABSTRACT

A concrete dowel slip tube assembly is provided for use in maintaining a planner consistency of a cured concrete slab formed on a support surface. The assembly comprises a plurality of elongate slip tubes, each having a length dimension and a tubular hollow interior compartment. Dowels are slidingly engageable to the hollow interior compartment to allow for translation along the interior compartment. A support frame defines a plurality of integral slip tube retaining members, disposed at evenly spaced locations along the support frame, the retaining members being configured to receive and engage associated slip tubes to the support frame in a common defined orientation. The support frame and the retaining members are formed as a unitary construction.

11 Claims, 4 Drawing Sheets

Related U.S. Application Data continuation of application No. 16/233,463, filed on Dec. 27, 2018, now abandoned, which is a continuation of application No. 15/847,227, filed on Dec. 19, 2017, now abandoned.

(56) References Cited

U.S. PATENT DOCUMENTS

| | | | |
|---|---|---|---|
| 2,642,789 | A | 6/1953 | Brickman |
| 2,858,749 | A | 11/1958 | Crone |
| 4,883,385 | A | 11/1989 | Kaier |
| 5,363,619 | A | 11/1994 | McPhee |
| 5,487,249 | A | 1/1996 | Shaw et al. |
| 5,618,125 | A | 4/1997 | McPhee et al. |
| 6,019,546 | A | 2/2000 | Ruiz |
| 6,092,960 | A | 7/2000 | McCallion |
| 6,145,262 | A | 11/2000 | Schrader et al. |
| 6,171,016 | B1 | 1/2001 | Pauls et al. |
| 6,210,070 | B1 | 4/2001 | Shaw et al. |
| 6,354,760 | B1 | 3/2002 | Boxall et al. |
| 6,447,203 | B1 | 9/2002 | Ruiz et al. |
| 6,775,952 | B2 | 8/2004 | Boxall et al. |
| 6,926,463 | B2 | 8/2005 | Shaw et al. |
| 7,314,334 | B1 | 1/2008 | Bennett et al. |
| 7,404,691 | B2 | 7/2008 | Bennett et al. |
| 7,481,031 | B2 | 1/2009 | Boxall et al. |
| 7,637,689 | B2 | 12/2009 | Boxall et al. |
| 7,716,890 | B2 | 5/2010 | Boxall et al. |
| 7,736,088 | B2 | 6/2010 | Boxall et al. |
| 7,874,762 | B2 | 1/2011 | Shaw et al. |
| 7,967,528 | B2 | 6/2011 | Mercer et al. |
| 8,142,104 | B2 | 3/2012 | Mercer et al. |
| 8,302,359 | B2 | 11/2012 | Boxall et al. |
| 8,303,210 | B2 | 11/2012 | Parkes et al. |
| 8,356,955 | B2 | 1/2013 | Nadler |
| 8,381,470 | B2 | 2/2013 | Boxall et al. |
| 8,511,935 | B1 | 8/2013 | Thomas |
| 8,573,884 | B2 | 11/2013 | Nadler |
| 8,627,626 | B2 | 1/2014 | Boxall et al. |
| 9,340,969 | B1 | 5/2016 | Shaw |
| 9,458,638 | B2 | 10/2016 | Parkes et al. |
| 9,541,111 | B1 | 1/2017 | Galligan et al. |
| 9,617,694 | B2 | 4/2017 | Shaw |
| 9,897,124 | B1 | 2/2018 | Galligan et al. |
| 2008/0085155 | A1 | 4/2008 | Bennett et al. |
| 2014/0248076 | A1 | 9/2014 | Shaw |
| 2015/0197898 | A1 | 7/2015 | Shaw |
| 2016/0222599 | A1 | 8/2016 | Smith |
| 2017/0096810 | A1 | 4/2017 | Shaw |

CONCRETE DOWEL SLIP TUBE ASSEMBLY

CROSS-REFERENCE TO RELATED APPLICATIONS

The present application is a continuation patent application of U.S. patent application Ser. No. 16/740,134 filed on Jan. 10, 2020, which is a continuation patent application of U.S. patent application Ser. No. 16/233,463 filed on Dec. 27, 2018, which is a continuation patent application of U.S. patent application Ser. No. 15/847,227 filed on Dec. 19, 2017, the entire contents of which are incorporated herein by reference.

STATEMENT RE: FEDERALLY SPONSORED RESEARCH/DEVELOPMENT

Not Applicable

BACKGROUND

The present invention generally relates to the art of concrete construction, and more particularly to a device for facilitating the placement of slip dowel rods within a concrete slab.

In the art of concrete construction, it is commonplace to form "cold joints" between two or more poured concrete slabs. Such cold joints frequently become uneven or buckled due to normal thermal expansion and contraction of the concrete and/or compaction of the underlying soil caused by inadequate substrate preparation prior to pouring of the concrete. As a means of preventing buckling or angular displacement of such cold joints, it is common practice to insert smooth steel dowel rods, generally known as slip tubes or slip dowels, within the edge portions of adjoining concrete slabs in such a manner that the concrete slabs may slide freely along one or more of the slip dowels, thereby permitting linear expansion and contraction of the slabs while at the same time maintaining the slabs in a common plane and thus preventing undesirable buckling or unevenness of the cold joint and in adjacent slabs.

In order to function effectively, slip dowels must be accurately positioned parallel within the adjoining concrete slabs. The non-parallel positioning of the dowels will prevent the desired slippage of the dowels and will defeat the purpose of the "slip dowel" application. Additionally, the individual dowels must be placed within one or both of the slabs in such a manner as permit continual slippage or movement of the dowels within the cured concrete slab(s).

In commonplace to form large concrete slabs using monolithic or continuous concrete pour methods. Such slabs are formed by continuously pouring large quantities of concrete without the use of forms or cold joints in order to reduce costs. Therefore, fracturing of the slab is prevented by including tooled joints or sawcuts in the slab where cold joints would otherwise be needed. Additionally, concrete reinforcement material such as wire mesh or segments of rebar are initially placed into the area in which the continuous pour is to be made, and in particular those areas where it is contemplated that sawcuts will be included in the resultant slab for purposes of preventing fracturing thereof. The wire mesh or other reinforcement material is preferably elevated above ground level by the placement thereof upon a support foot or seat.

In addition to having concrete reinforcement material disposed within those portions of the slab in which a sawcut is to be made, it is also desirable to incorporate slip dowels into such portions to allow the separate sections of the slab which are defined by the sawcuts to move relative to each other while preventing any buckling or angular displacement thereof. One prior art method of incorporating slip dowels into those areas of a continuous pour where sawcuts are contemplated involves manually "stabbing" the slip dowels into predetermined locations of the uncured concrete pour. This method, however, is deficient in that there is no way to insure that the slip dowels will be manually positioned within the uncured concrete in parallel relation to each other, or will be maintained in parallel alignment to the top surface of the concrete pour during curing. As previously explained, if the dowel rods are not in parallel alignment, the separate sections of slab as defined by the sawcuts will be prevented from moving relative to each other.

Another prior art method of incorporating slip tubes into a monolithic pour involves manually tieing the slip dowels, or slip tubes to the reinforcement material in parallel relation to each other prior to the concrete pour being made. Manual tieing, however, is extremely time consuming and presents significant difficulties in securing the slip tubes to the reinforcement material in true parallel relation to each other. Additionally, the tied slip tubes are susceptible to displacement or shifting when impacted by the concrete during the pour thus moving the same out of parallel alignment with each other.

In another prior art configuration of the support structure may be fabricated from concrete reinforcing wire. Each top segment, side segment, and bottom portion may be formed from a single section of concrete reinforcing wire by bending such material into the desired generally U-shaped configuration. Then the top, side and base stringers may be welded at their respective locations in order to from the support structure slip tubes are then attached to the top side stringer.

The present invention addresses and overcomes the above-described deficiencies associated with the labor intensive formation of the support structure and slip tube placement in continuous concrete pours by providing prefabricated support structure that readily receives and inherently aligns the slip tubes accurately during the pouring of such concrete slabs. In this respect, the present invention provides an accurate and easy to use assembly for slip tube and dowel placement in a monolithic pour.

BRIEF SUMMARY

A concrete dowel slip tube assembly is provided for use in maintaining a planner consistency of a cured concrete slab formed on a support surface. The assembly comprises a plurality of elongate slip tubes, each having a length dimension and a tubular hollow interior compartment. Dowels are slidingly engageable to the hollow interior compartment to allow for translation along the interior compartment. A support frame defines a plurality of integral slip tube retaining members, disposed at preferably evenly spaced locations along the support frame, the retaining members being configured to receive and engage associated slip tubes to the support frame in a common defined orientation. The support frame and the retaining members are preferably formed as a unitary construction.

The slip tube retaining members are preferably configured to receive and orient the slip tubes along the frame length, substantially perpendicular to the support frame length.

The slip tube retaining members may comprise first and second opposing prongs, which collectively define arcuately contoured recess therebetween for receiving and retaining the slip tubes.

Alternately, the slip tube retaining members may comprise arcuately contoured straps, which define and arcuate recess for receiving and engaging the slip tubes. In one embodiment, the slip tubes are engaged to, or otherwise form a portion of the support frame, to define the unitary structure including the support frame (with the slip to retaining members) and the slip tubes.

A plurality of support seats, which are disposable about the support surface, and configured to receive and support the slip tubes, e.g., when the slip tubes are engaged to the support frame. The support seats may alternatively/additionally be configured to support the support frame (e.g., along the side supports or cross members) and dowels.

The support seats may include a height adjustable and screw and engager, for maintaining planner orientation of the support frame and the dowels over in a regular surface.

The engager may define a plurality of arcuate recesses for engaging the slip tubes, the dowels, the frame support side members and/or the frame support cross members.

Alternatively, the support frame may be formed to include downwardly extending support legs, which form a unitary construction with the support frame. The support legs may be provided with height adjustable feet, to maintain planner orientation of the support frame and the dowels, over in a regular surface.

In one embodiment, the support frame (including the slip tube engaging members), the slip tubes and the support seat, or the support legs, may be formed as a unitary structure.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The following description is given by way of example, and not limitation. Given the following disclosure, one skilled in the art could devise variations that are within the scope and spirit of the invention disclosed herein, including various ways of engaging the slip tube to the support structure. Further, the various features of the embodiments disclosed herein can be used alone, or in varying combinations with each other and are not intended to be limited to the specific combination described herein. Thus, the scope of the claims is not to be limited by the illustrated embodiments.

Figure 1:
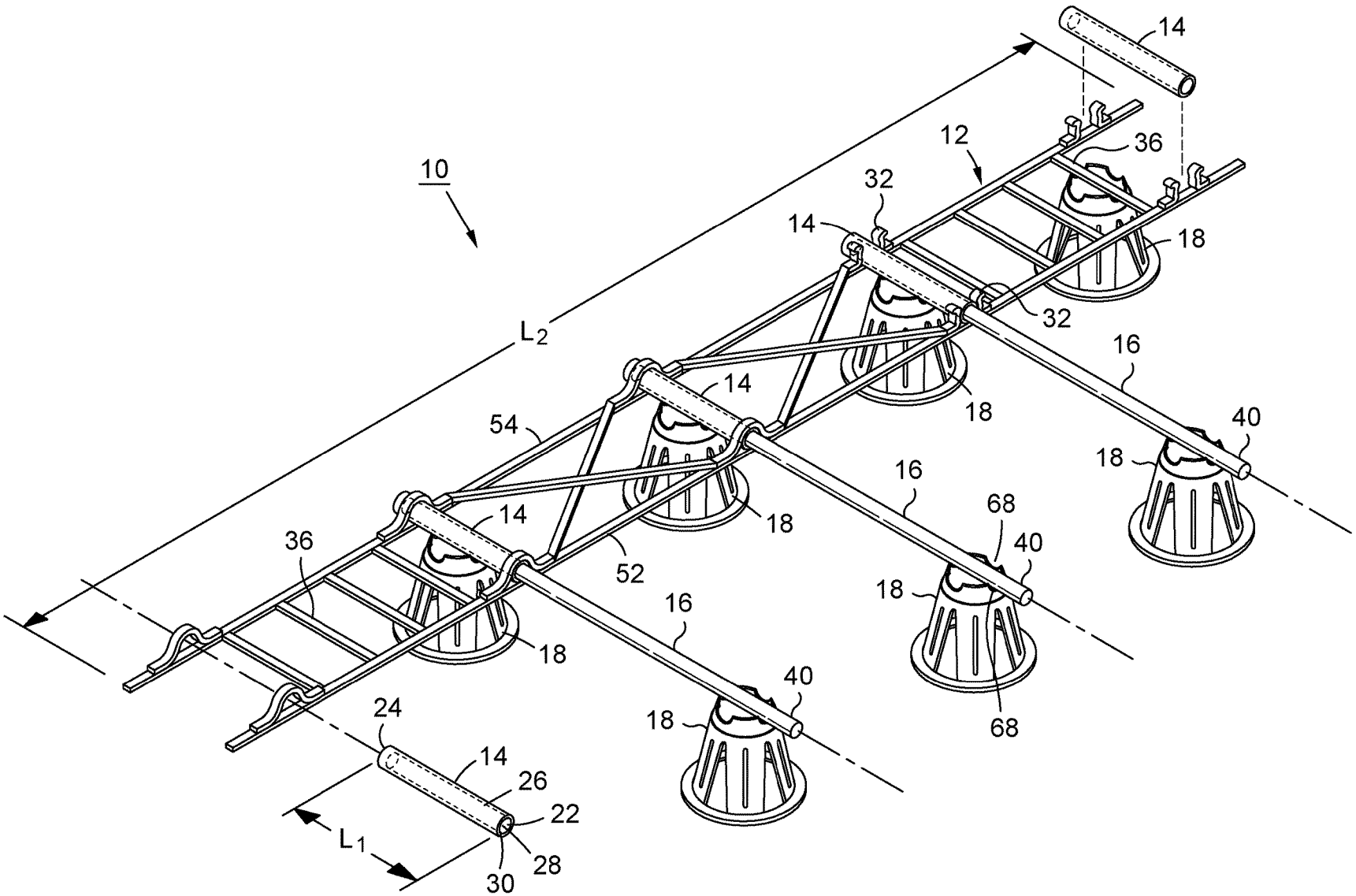
FIG. 1 is a perspective view of a concrete dowel slip tube assembly of the present invention constructed in accordance with a first embodiment thereof.

Referring now to the drawings wherein the showings are for purposes of illustrating preferred embodiments of the present invention only, and not for purposes of limiting the same, FIG. 1 perspectively illustrates a concrete dowel slip tube assembly 10 for use with monolithic or continuous pour concrete construction techniques. The assembly 10 comprises a support structure 12, constructed in accordance with a first embodiment of the present invention, and at least one concrete dowel slip tube 14 attached thereto. The assembly additionally comprises a concrete support dowel 16 and a dowel support seat 18. Support structure 12 may be constructed to define side segments 52, 54 and a plurality of cross members 36, collectively formed as a unitary structure (i.e., molded with the support structure from the same plastic material, or otherwise engaged to the support structure in a manner that precludes non-destructive disengagement).

Figure 2:
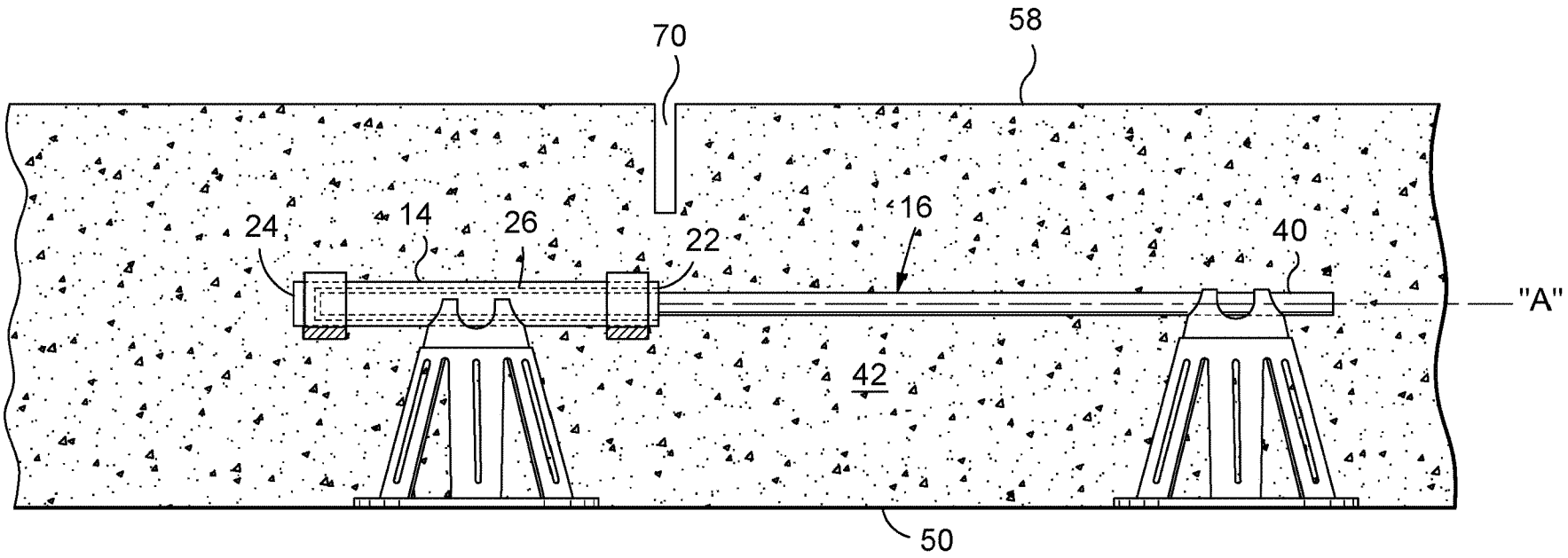
FIG. 2 is a cross-sectional view of the concrete dowel slip tube and support structure shown in FIG. 1 in an operative position within a monolithic concrete pour.

Referring now to FIGS. 1 and 2, the dowel 16 is sized such that it is slidably insertable into the interior compartment 30 of the slip tube 14. The slip tube 14 is typically fabricated from a plastic material such that the dowel 16 may freely slide therewithin. The dowel 16 extends outwardly from the open end 22 of slip tube 14 such that an extended end 40 of dowel 16 is firmly adhered by a concrete slab 42 poured thereover. The dowel 16 may be fabricated from a section of rebar or other type of material with the necessary strength to prevent buckling or angular displacement of the concrete slab 42, as will be further explained below. Additionally, the dowel 16 may be formed with ribs or ridges (not shown) on an exterior surface thereof to facilitate frictional retention within the concrete slab 42.

The slip tube 14 constructed in accordance with the present invention is used for supporting the concrete dowel 16 slidably insertable therein. As seen in FIGS. 1 and 2, the slip tube 14 may be constructed as an elongate tube, with an open proximal end 22 and a closed distal end 24. The slip tube 14 has a generally circular cross-sectional area with an exterior surface 26, and an inner surface 28 which defines a hollow, longitudinally extending interior compartment 30 therewithin. Typically, the longitudinal length "L1" of the slip tube 14 is between about 6.0 inches and about 30.0 inches. The interior compartment 30 is sized slightly larger than the outer diameter of the concrete support dowel 16. The outer surface 26 of slip tube 14 may further be provided with ribs or ridges (not shown) to facilitate frictional retention as will be further explained below.

Figure 3A:
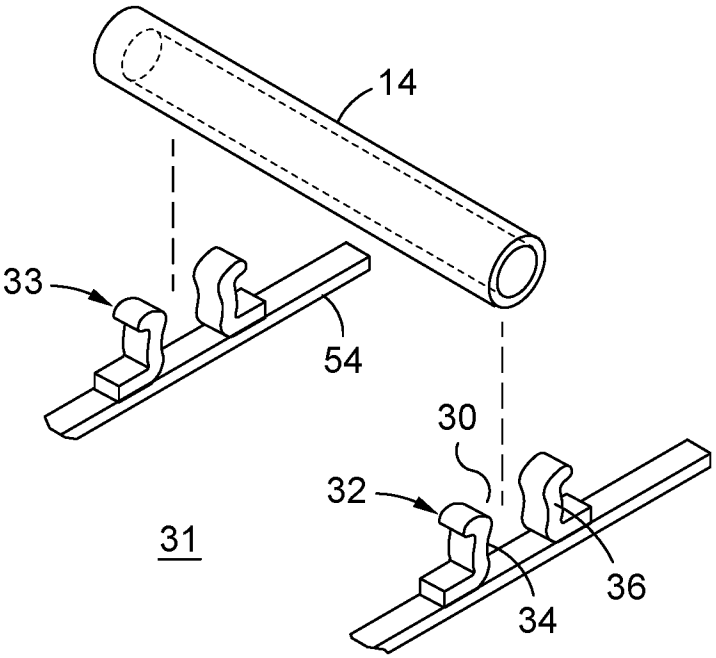
FIG. 3A is an exploded view illustrating one implementation of the concrete dowel slip tube engaging member, for securing the slip tube to the support structure as shown in FIG. 1.

Referring to FIGS. 1 and 3A, slip tube retaining member 31 is shown, which defines clips 32, 33, which are shown mounted on the exterior surface of the support structure 12. Clips 32, 33 used to releasably attach the slip tube 14 to the support structure 12. The clips 32, 33 can be integrally connected to support structure 12 to collectively form a unitary structure. Alternatively clips 32, 33 may be detachably attached to the support structure 12. The clips 32, 33 may comprise a first prong 34 and a second prong 36 which collectively define an arcuately contoured recess 38 which is sized and configured to receive the slip tube 14. The prongs 34 and 36 may be fabricated from a flexible material such that receipt of the slip tube 14 into the recess 38 facilitates a slight outward flexation of prongs 34, 36 and frictional retention thereof to support structure 12. As shown at FIG. 1, the clips 32, 33 retains the slip tube 14 in a position substantially perpendicular to the length L2 of the support structure 12, whereby the concrete support dowel 16 inserted therein is supported in a prescribed position as will be further explained below. As explained further below, the tube retaining members are preferably spaced evenly along the length of the support frame 12 to facilitate the use of support frames at both ends of the dowels 16. This provides additional advantages in relation to the ease of installation and alignment of the dowels.

Figure 3B:
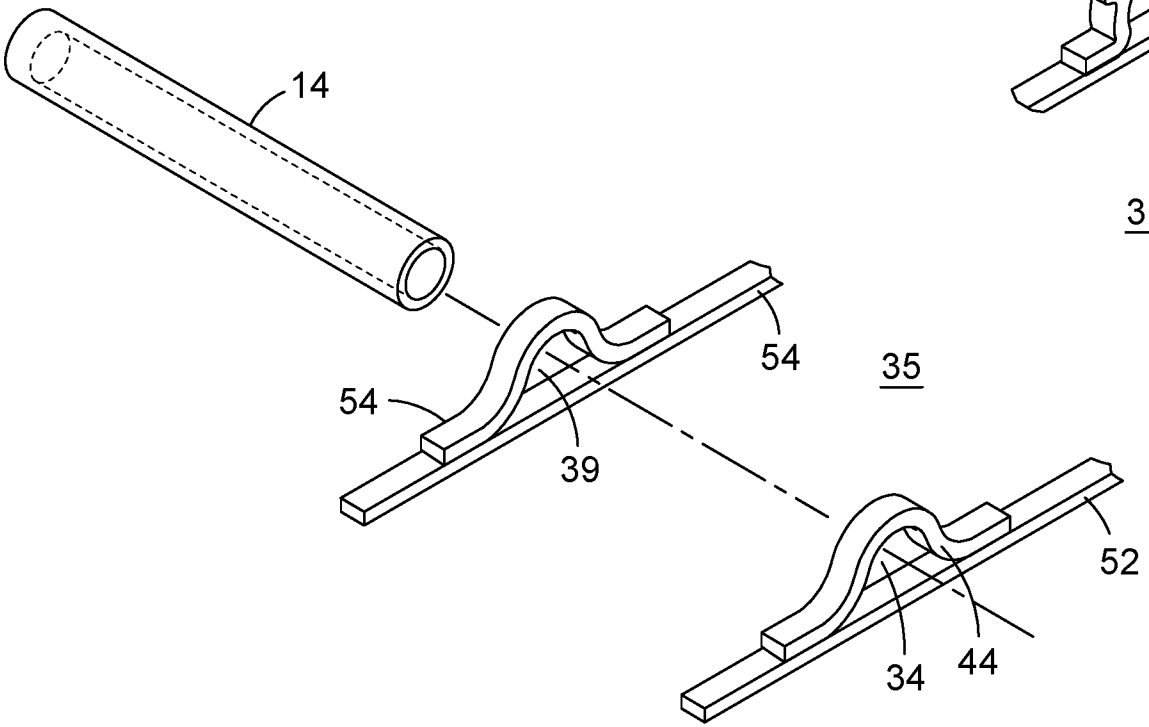
FIG. 3B is an exploded view illustrating an alternative implementation of the concrete dowel slip tube engaging member, for securing the slip tube to the support structure as shown in FIG. 1.

Alternatively, the retaining member 35 may be implemented as straps or other retainers, such as arcuate straps 44, 45. Referring to FIGS. 1 and 3B, straps 44, 45 are similarly used to releasably attach the slip tube 14 to the support structure 12. The straps 44, 45 can be integrally connected to support structure 12 to form a unitary structure or detachably attached to the support structure 12. The straps 44, 45 may define an arcuately contoured recess 39, sized and configured to receive the slip tube 14. The straps 44, 45 may be fabricated from a flexible material such that receipt of the slip tube 14 into the recess 38 facilitates a slight outward flexation of the straps 44, 45 to facilitate frictional retention of the slip tube to the support structure 12. The straps 44, 45 retain the slip tube 14 in a position substantially perpendicular to the length L2 of the support structure 12, whereby a concrete support dowel 16 inserted therein is supported in a prescribed position as will be further explained below.

As will be apparent to those of ordinary skill in the art, the construction of a prefabricated support frame, having integral support tube retainer members, provide significant advantages in the construction of a concrete dowel slip tube assembly. By having the slip to slip tube retaining members integrated into the support frame, the orientation of the slip tubes, relative to the support frame, is fixed and does not require manual adjustment of the support frame, or manual alignment of the slip tubes relative to the support frame. This provides consistency of orientation of the slip tubes along the support frame and mitigates labor and skill requirements to properly array with the concrete reinforcing structure in a manner that permits linear expansion and contraction of the concrete slabs, while at the same time maintaining the slabs in a common plane, to prevent undesirable buckling and unevenness between adjacent slabs. Once the support frame is arrayed above the surface, e.g., upon the support seat or integral support legs, dowels can be extended into the slip tubes at one or both ends by simply translating the support structure to match up the support tubes with the other end of the dowels.

As further described below, the unitary construction may further include integral support legs, extending downwardly from the support frame, to avoid the need for arranging the support seats below the sport frame. The support tubes may also be formed integral with the support frame. These and other advantages of the present invention are described further below.

Referring again to FIG. 2, the support dowel 16 is sized such that it is slidably insertable into the interior compartment 30 of the slip tube 14. The slip tube 14 is typically fabricated from a plastic material such that the support dowel 16 may freely slide therewithin. The support dowel 16 extends outwardly from the open end 22 of slip tube 14 such that an extended end 40 of dowel 16 is firmly adhered by a concrete slab 42 poured thereover. The dowel 16 may be fabricated from a section of rebar or other type of material with the necessary strength to prevent buckling or angular displacement of the concrete slab 42, as will be further explained below. Additionally, the dowel 16 may be formed with ribs or ridges (not shown) on an exterior surface thereof to facilitate frictional retention within the concrete slab 42.

Clips 32, 33 and straps 44, 45 are configured on the surface of support structure 12, or formed within the support structure 12, to maintain a plurality of concrete dowel slip tubes 14 in a substantially parallel relationship to one another and parallel to a top surface 58 of concrete slab 42. Additionally, the clips 32, 33 and/or straps 44, 45, connected to the side segments 52, 54 of support structure 12. Each side segment 52, 54 of support structure 12 is attached to cross member 36 such that the side members 52, 54 are in parallel alignment with each other to maintain the slip tubes in substantially coplanar relationship. Additionally, each support seat 18 is sized such that each clip 32 and retainer 44 is elevated above the ground 50 in substantially the same vertical plane. In one embodiment, each support seat 18 has a height of between about 2.5 inches to about 24.0 inches. The clip 32 and/or retainer 44 are spaced to receive and engage the slip tube 14. As such, in one embodiment the length of cross member 36 is between about 6.0 inches to about 30.0 inches, and the cross member 26 may be spaced along the support structure between about 6.0 to about 30.0 inches.

Figures 4, 5:
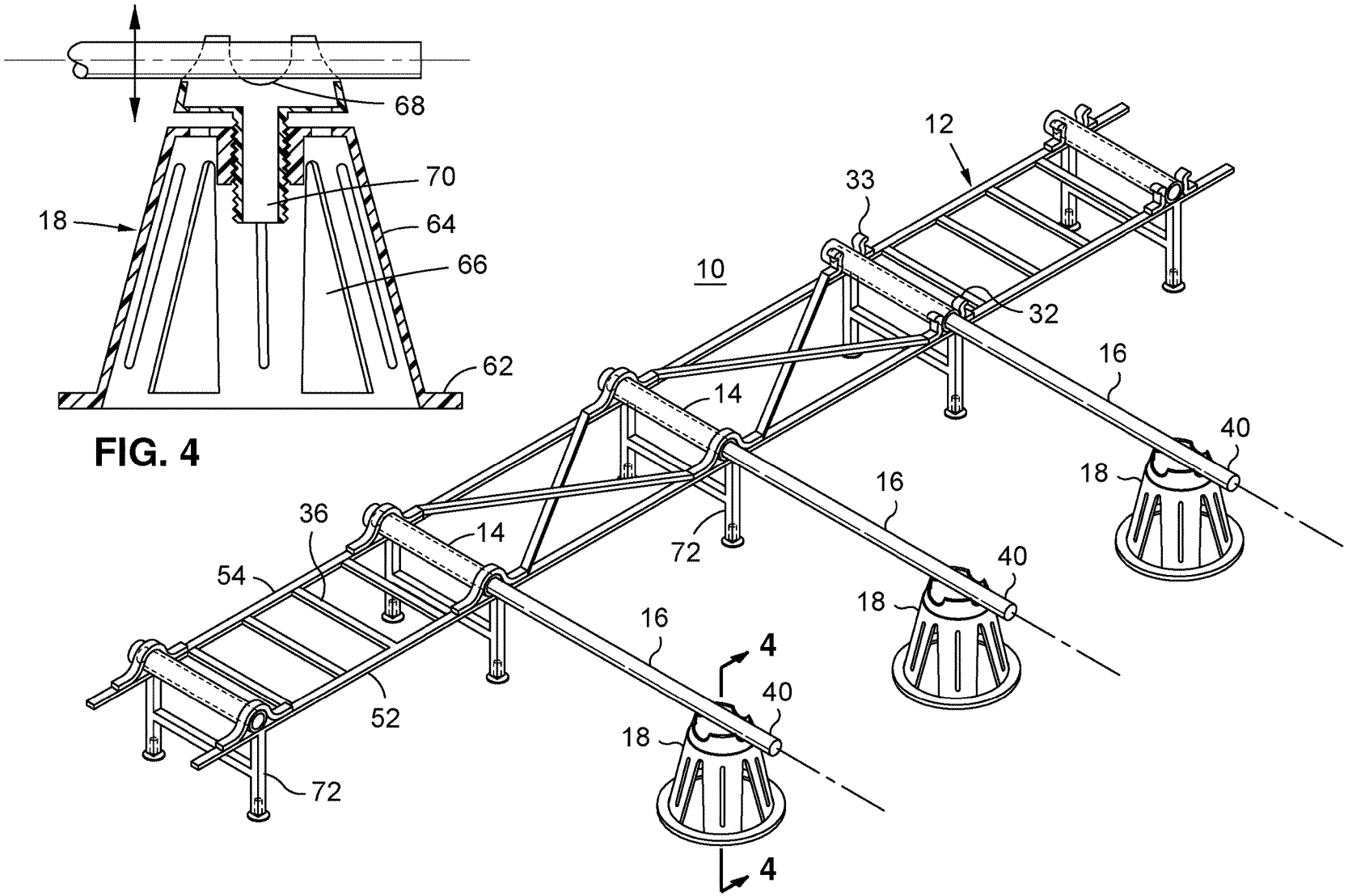
FIG. 4 is a sectional view of an exemplary dowel support seat, having a height adjustable engaging surface.
FIG. 5 is a perspective view of a concrete dowel slip tube assembly in accordance with a second embodiment of the invention.

The concrete dowel slip tube assembly 10 additionally comprises the support seat 18. As shown in FIGS. 1, 2 and 4, the support seat 18 supports the extended end 40 of support dowel 16. The support seat 18 may alternately or additionally be used to support the slip tubes 14, and/or the support structure, at locations such as the integral side segments 52, 54 and/or the integral support structure cross members 36.

As seen in FIG. 4, the support seat 18 may comprise a generally annular base portion 62 that supports a frustum shaped wall 64. The wall 64 may be provided with a plurality of openings 66 for access to the interior of the support seat 18 during pouring of concrete. The support seat 18 is sized and configured to receive the support dowel 16, slip tube 14, side segment 52 or cross member 36 in at least one of the engagers 68, formed about a top of the base portion 62. The engagers 68 may be sized with an interior diameter slightly smaller than the outside diameter of the slip tube 14, the support dowel 16 or other supported structure, in order to frictionally engage the supported structure Therefore, an engager 68 can "snap" onto the supported structure, e.g., the extended end 40 of support dowel 16 or other structure.

In one embodiment, as shown at FIG. 4, the engager 68 may be height adjustable in relation to base portion 62, e.g., by rotation of the engager 68 and connecting screw 70, to facilitate maintaining the dowels or other supported structure in a common plane where the ground 50 is irregular.

In another embodiment, shown at FIG. 5, the support seat may be implemented as frame member, downwardly extending support legs 72, engaged to the support frame 12. The support legs 72 may be integrated into the support frame 12, e.g., along side segments 52, 54, to form a unitary structure. In some embodiments the unitary structure may also include slip tube 14. Height adjustable feet 74 may be connected to the support legs 72, to accommodate installation of the unitary support frame 12 and legs 72 on an irregular ground surface 50.

Now having described the components of the concrete dowel slip tube assembly 10, the function and method of using each component will be explained. Reference to the first embodiment of the support structure 12 will be made herein, yet it will be recognized that other embodiments support structure 12 can be interchanged with the described embodiment in the following description of use. First, slip tubes 14 are attached to the support structure 12 via clips 32, 33 or straps 44, 45. The slip tubes 14 are typically spaced about 6.0 to 30.0 inches between adjacent slip tubes. As seen in FIG. 1, the slip tubes 14 may be spaced by four cross member 36.

Next, the support structure 12 is positioned in the location where a sawcut 70 will be made in the monolithic concrete slab 42 after pouring and curing thereof. As seen in FIG. 2, the support seat 18 is placed upon the ground surface 50 that supports the concrete slab 42. The support seat 18 is substantially flush with the surface 50. Next, the support structure 12 is positioned such that the central axis "A" of the slip tubes 14 is parallel to the top surface 58 of concrete slab 42 after pouring thereof. As will be recognized to those of ordinary skill in the art, it is also possible to position the support structure 12 on ground surface 50 before the slip tubes 14 are attached thereto. As such, once the support structure 12 is in proper position and location, the slip tubes 14 may be connected to the clips 32, 33 or straps 44, 45 as needed.

Before the concrete slab 42 is poured, the concrete support dowels 16 are inserted within a respective slip tube 14. As previously described above, the support structure 12 is configured to support the slip tubes 14 and support dowels 16 inserted therein in a substantially parallel and coplanar relationship to one another, and parallel to the top surface 58 of concrete slab 42. The support dowels 16 are slidable within a respective slip tube 14 in order to provide lateral displacement of the concrete slab 42 as will be further explained below. The extended end 40 of dowel 16 projects outwardly from the slip tube 14 such that the support structure 12 may become imbalanced and tend to tip toward surface 50. If this happens, then support seat 18 is attached to the extended end 40 of dowel 16 to provide additional support thereto. The support seat 18 has a height, or is adjustable to have a height which coaxially aligns the support dowel 16 with the central axis "A" of slip tube 14 when support dowel 16 is attached to a respective dowel engager 68 of support seat 18. The dowel 16 must be easily slidable within the slip tube 14 for proper operation. Therefore, the central axis "A" of slip tube 14 must be coaxially aligned with support dowel 16 in order to prevent binding of the dowel 16 within slip tube 14, as the slip tube 14 is slightly larger than the diameter of the support dowel 16. Additionally, support seat 18 aligns the support dowel 16 to axis "A" of slip tube 14 during pouring of the concrete because the weight of the concrete can cause the support dowel to bend and therefor bind on slip tube. As such, the support seat 18 provides support to extended end 40 of dowel 16 to maintain slip tube 14 substantially perpendicular alignment with support structure 12.

After having placed the dowels 16 into respective slip tubes 14, the concrete slab 42 is formed by pouring concrete around the support structure 12. The concrete encapsulates the support structure 12, the exposed portion of the support dowel 16 and the support seat 18. Since the support seat 18 is provided with openings 66 formed therein, the concrete is able to fully surround and encapsulate support seat 18. Therefore, support seat 18 can remain in place after the concrete has cured. Typically, the height of the support structure 12 is chosen to position the support dowels 16 midway between the top surface 58 of concrete slab 42 and the supporting ground surface 50.

After the concrete slab 42 has cured, the sawcut 70 is formed on the top surface 58 of concrete slab 42 by sawing the slab 42 with standard concrete construction techniques. The sawcut 70 is located perpendicular to the central axis "A" of the slip tubes 14. Additionally, the sawcut 70 must be located at the junction where the support dowel 16 enters the slip tube 14 (i.e., near the open end 22 of slip tube 14). Since the dowel 16 is longitudinally slidable within the slip tube 14, the concrete slab 42 may be laterally displaced about sawcut 70. The portion of the support dowel 16 extending within the slip tube 14 is allowed to move freely in a longitudinal direction, whereas the portion of the dowel 16 extending into the concrete slab 42 is frictionally retained therein. The closed end 24 of slip tube 14 prevents the seepage of concrete thereinto such that the portion of dowel 16 within the slip tube 14 is freely slidable in a generally horizontal direction. Therefore, the sawcut 70 is placed at the junction between the dowel 16 and slip tube 14 since this is the location whereby the dowel 16 is freely slidable horizontally. However, the dowel 16 is not movable in a vertical direction within slab 42 because it is encapsulated by concrete or retained within slip tube 14. Therefore, the dowel 16 can prevent buckling or angular displacement of concrete slab 34 in the area whereby dowel 16 is positioned.

The present invention accurately positions concrete support dowels 16 during the pouring of the monolithic concrete slab 42. As such, the positioning and configuration of the slip tubes 14 can be easily and quickly changed by varying the size of slip tube 14 and corresponding concrete support dowel 16, as well as the size of the slip tube support structure.

Additional modifications and improvements of the present invention may also be apparent to those of ordinary skill in the art such as varying the configuration of the slip tube support structure as well as other configurations for the slip tube retaining members. Thus, the particular combination of parts described and illustrated herein is intended to represent only certain embodiments of the present invention, and is not intended to serve as limitations of alternative devices within the spirit and scope of the invention.

What is claimed is:

1. A concrete dowel slip tube assembly for use in maintaining planar constancy of a hardened concrete slab formed on a support surface, the assembly comprising:
   - a support frame having a first side segment member and a second side segment member extending in spaced relation to the first side segment member;
   - a plurality of first clip members extending from the first side segment member and a plurality of second clip members extending from the second side segment member; and
   - a plurality of elongate slip tubes, each slip tube having a slip tube length dimension and a tubular hollow interior compartment and being sized and configured to be circumferentially engageable with a respective one of the first clip members and a respective one of the second clip members and to extend between the first and second side frame members when engaged therewith.

2. The concrete dowel slip tube assembly as recited in claim 1 wherein the plurality of first and second clip members are configured to orient the slip tubes substantially perpendicular to the first and second side segment members.

3. The concrete dowel slip tube assembly as recited in claim 2 wherein each of the first and second clip members comprises first and second opposing prongs which collectively define an arcuately contoured recess therebetween and are engageable to the slip tubes.

4. The concrete dowel slip tube assembly as recited in claim 2 wherein each of the first and second clip members comprises an arcuately contoured strap connected to one of the first and second side segment members.

5. The concrete dowel slip tube assembly as recited in claim 1 further comprising a plurality of support seats disposable about the support surface, the support seats being configured to receive and support the support frame.

6. The concrete dowel slip tube assembly as recited in claim 5 wherein the support seats are engaged to the slip tubes.

7. The concrete dowel slip tube assembly as recited in claim 6 wherein the support seats and the slip tubes are formed as a unitary structure.

8. The concrete dowel slip tube assembly as recited in claim 5 wherein the support seats define a base disposable on the support surface and an engager disposed on the base, the engager being height adjustable relative to the base.

9. The concrete dowel slip tube assembly as recited in claim 1 further comprising a plurality of support seats disposable on the support surface, the support seats being configured to support the first and second support frame members above the support surface.

10. The concrete dowel slip tube assembly as recited in claim 1 further comprising a plurality of support frame cross members extending between the first and second support frame segments, each support seat being configured to engage with a respective one of the plurality of support frame cross members.

11. The concrete dowel slip tube assembly as recited in claim 10 wherein each support frame cross member extends generally perpendicularly relative to the first and second support side segment members.

* * * * *